US007004337B2

(12) United States Patent
Lissandre

(10) Patent No.: US 7,004,337 B2
(45) Date of Patent: Feb. 28, 2006

(54) FOLDABLE CAB/PIVOT UNIT FOR A TOWER CRANE

(75) Inventor: Michel Lissandre, Yzeure (FR)

(73) Assignee: Potain, Ecully (FR)

( * ) Notice: Subject to any disclaimer, the term of this patent is extended or adjusted under 35 U.S.C. 154(b) by 190 days.

(21) Appl. No.: 10/409,446

(22) Filed: Apr. 9, 2003

(65) Prior Publication Data

US 2003/0217984 A1 Nov. 27, 2003

(30) Foreign Application Priority Data

Apr. 25, 2002 (FR) ..... 02 05234

(51) Int. Cl.
*B66C 23/26* (2006.01)

(52) U.S. Cl. ..... 212/291; 212/175; 212/176

(58) Field of Classification Search ..... 212/291, 212/175, 176

See application file for complete search history.

(56) References Cited

FOREIGN PATENT DOCUMENTS

| | | | |
|---|---|---|---|
| DE | 530 158 | | 7/1931 |
| DE | 1195916 | * | 7/1963 |
| DE | 33 37 163 C2 | * | 4/1994 |
| EP | 0 870 725 | * | 10/1998 |
| FR | 2164927 | | 12/1972 |
| FR | 2 565 950 A1 | | 12/1985 |
| FR | 2639339 | | 5/1990 |
| GB | 1375590 | | 11/1974 |
| GB | 1411177 | * | 10/1975 |
| WO | WO 91/04220 | | 4/1991 |

OTHER PUBLICATIONS

Model MDT 132 Crane, Potain Technik brochure, Jul. 2001, p. 3.17.

* cited by examiner

*Primary Examiner*—Thomas J Brahan
(74) *Attorney, Agent, or Firm*—Oliff & Berridge, PLC

(57) ABSTRACT

The cab/pivot unit comprises an upper mast element associated with a pivot, an access platform which extends horizontally at one side of the mast element, and a driver's cab mounted pivotably about a vertical axis located at the side of the mast element and linked to this element. The cab is orientable manually (arrows F1, F2) through approximately 90° between an operating position, in which it is located in the extension of the access platform, in front of the mast element, and a transport position, in which this cab is folded above the platform, against the mast element. The invention is used for tower cranes with a "suspended" cab.

12 Claims, 6 Drawing Sheets

FOLDABLE CAB/PIVOT UNIT FOR A TOWER CRANE

BACKGROUND OF THE INVENTION

The invention relates, in general terms, to the technical field of tower cranes, such as those used on building construction sites. More particularly, this invention is concerned with tower cranes having what are known as "suspended" driver's cabs, and, even more specifically, its subject is a foldable cab/pivot unit for a tower crane of this type.

DESCRIPTION OF THE PRIOR ART

In a tower crane, the "suspended" driver's cab can be associated with the pivot located at the top of the mast and serving for orienting the jib of the crane, in order to form an assembly designated as a "cab/pivot unit". One example of a cab/pivot unit can be found in the document FR 256 5950 A; here, the cab occupies a fixed position in relation to the jib of the crane, the cab/pivot unit not being intended to be foldable.

In view of the dimensions of such a cab/pivot unit and because of the constraints attached to the transport of the crane, for example, from one site to another, however, it is advantageous to implement the cab/pivot unit in such a way that it is at least partially foldable.

In a known embodiment, already used by the company POTAIN TECHNIK and described particularly in the brochure of its crane MDT 132, page 3.17, the folding of the cab/pivot unit is provided by a tilting of the cab about a horizontal axis. This folding principle and the overall design of the cab/pivot unit which results from this still have various disadvantages:

- The use of an auxiliary handling appliance is necessary for the operations of unfolding and folding the cab/pivot unit.
- The "prone" position of the cab, in the folded transport position, makes it necessary to immobilize its internal components.
- The folding system is not suitable in the case of a spacious driver's cab, since the bulk of the cab/pivot unit, even in the folded transport position, is then greater than the dimensions of a container.
- Arrangements must be made to ensure the protection of the exposed surfaces of the cab in this folded transport position.
- During the unfolding of the cab/pivot unit in order to bring the cab into the operating position, it is still appropriate to assemble the elements for access to the cab, thus complicating and lengthening the operations of putting into the operating position.
- Moreover, access to the cab, on the one hand, and access for maintenance and adjustment operations, on the other hand, are separate, this being an uneconomical solution.
- Finally, in the operating position, the driver's cab is level with the jib of the crane, and this does not afford the crane operator optimum visibility for driving the crane.

SUMMARY OF THE INVENTION

The present invention is aimed at avoiding all these disadvantages by providing an improved cab/pivot unit which, while preserving a simple and economical structure, makes it possible, in particular, to carry out quickly and easily the bringing of the cab into the operating position, while at the same time allowing a folding of the cab into a minimum bulk and without the addition of protective elements.

To this effect, the subject of the invention is a foldable cab/pivot unit for a tower crane, which comprises essentially, in combination:

- an upper mast element associated with a pivot,
- a cab access platform extending at one side of the mast element, and
- a crane driver's cab mounted pivotably about a vertical axis located at the side of the mast element and linked to this mast element, the cab thus being orientable about said vertical axis and through approximately 90°, in particular by manual action, between:
- an operating position, in which this cab is located in the extension of the access platform, in front of the mast element, and
- a transport position, in which this cab is folded above the access platform, against the mast element.

According to one embodiment of this foldable cab/pivot unit, the driver's cab is articulated on the mast element by means of a vertical double hinge comprising, toward the mast element, an upper support and a lower support which are fastened respectively to the top and to the base of the mast element, and, toward the cab, an upper support and a lower support which are fastened respectively to the top and to the base of the carrying structure of the cab, the upper supports and the lower supports being connected by means of respectively upper and lower vertical axles.

Advantageously, the cab/pivot unit also comprises means for locking the driver's cab in its operating position and in its folded transport position. These locking means may consist as follows:

- for locking the driver's cab in the operating position: these means consist of plates integral respectively with the base of the cab and with the access platform to this cab and intended to be bolted to one another, so as to stiffen the access platform initially in a cantilevered manner;
- for locking the driver's cab in the folded transport position: these means consist of a turnbuckle tensioner mounted between the top of the mast element and the top of the carrying structure of the cab, in combination with an elastic stop fastened to the access platform, thus making it possible to damp the shocks during transport.

According to another advantageous arrangement, the access platform comprises a removable and/or inclinable lateral railing which:

- in the operating position of the driver's cab, is fastened in a vertical position and is located in the extension of a lateral face of this cab, and
- in the folded transport position of the driver's cab, is fastened in a vertical position or in an oblique position projecting toward the outside of the access platform, so as to protect the front face of the cab, in particular the lower glazed part of this front face.

The means for fastening the lateral railing to the access platform to the cab may comprise, on one outer edge of said platform, double chocks receiving the feet of the uprights of the railing, at the same time, depending on the chock used, fixing the vertical or oblique orientation of these uprights and therefore of the railing.

The access platform to the cab also advantageously supports, perpendicularly to its lateral railing, an electrical cabinet which is thus accessible from this platform, the driver's cab, in the folded transport position, also taking its place against said electrical cabinet, in such a way that the lateral glazed part of the cab is also protected.

Overall, the foldable cab/pivot unit which is the subject of the invention possesses the following advantages:

- by virtue of its principle of folding the cab by orientation about a vertical axis, the cab can be unfolded or folded manually, quickly and without the need for an auxiliary handling appliance, thus allowing rapid and easy implementation on sites.
- The cab, even when folded, always remains in the "upright" position, so that there is no longer any risk of a fall of the internal components of the cab or any obligation to immobilize these components before the cab is folded.
- Even where a spacious cab is concerned, the method of folding the latter makes it possible to bring the cab/pivot unit into a reduced bulk, thus making it possible to transport it in a container.
- The access platform to the cab remains connected to the mast element, and, after the unfolding of the cab, it immediately occupies a position giving access to this cab, thus dispensing with any operations to bring up and assemble access elements.
- Moreover, this platform gives spacious common access to the driver's cab and to the electrical cabinet, thus forming a compact and economical arrangement making the operations of maintaining and adjusting the crane easier.
- The lateral railing of the access platform and the electrical cabinet supported by this platform are elements for protecting the cab in the folded transport position, thus making it unnecessary to have any additional protective elements for the painted surfaces and the windows of the cab. In particular, the lateral railing ensures the protection of the front window of the cab, the inclined position of the railing allowing adaptation to the usually rounded or projecting shape of the front face of the cab. As regards the electrical cabinet, this ensures the protection of the side window of the cab. Thus, the cab is suitably protected from the shocks which may occur during the transport and the handling of the cab/pivot unit. Furthermore, the placing of the cab against the electrical cabinet in the folded transport position ensures that access both to the cab and to the cabinet is prohibited, thus preventing thefts or malicious acts.
- Finally, in the operating position, the driver's cab takes its place below the jib of the crane, thus ensuring that the crane operator has optimum visibility for driving the crane.

The subject of the invention, as such, is also a tower crane comprising a foldable cab/pivot unit, as defined above.

BRIEF DESCRIPTION OF THE DRAWINGS

The invention will be understood more clearly from the following description, with reference to the accompanying diagrammatic drawing which illustrates, by way of example, an embodiment of this foldable cab/pivot unit for a tower crane and in which.

DESCRIPTION OF THE PREFERRED EMBODIMENT

Figure 1:
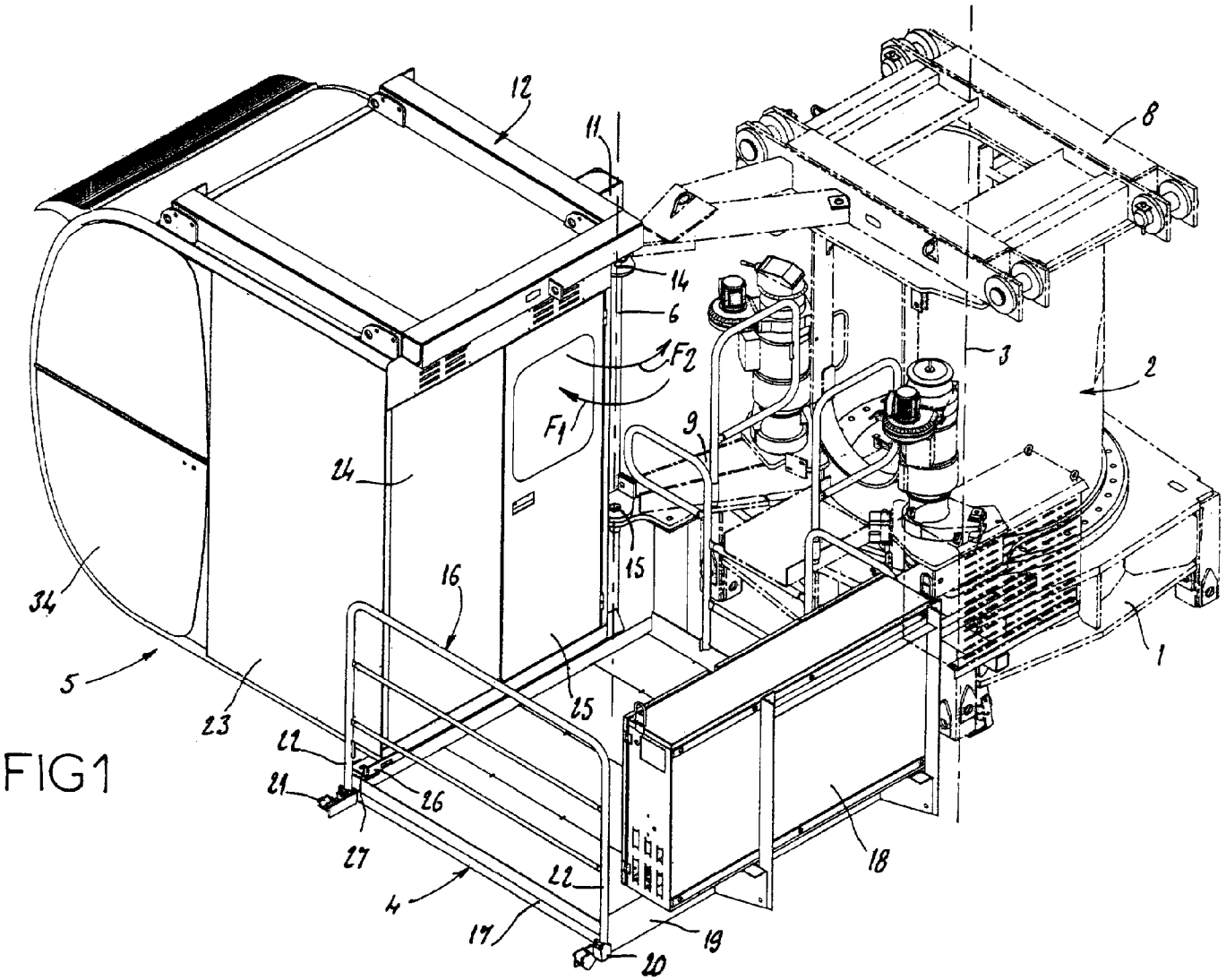
FIG. 1 is an overall perspective view of a cab/pivot unit according to the invention, the cab being in the operating position.
Figure 2:
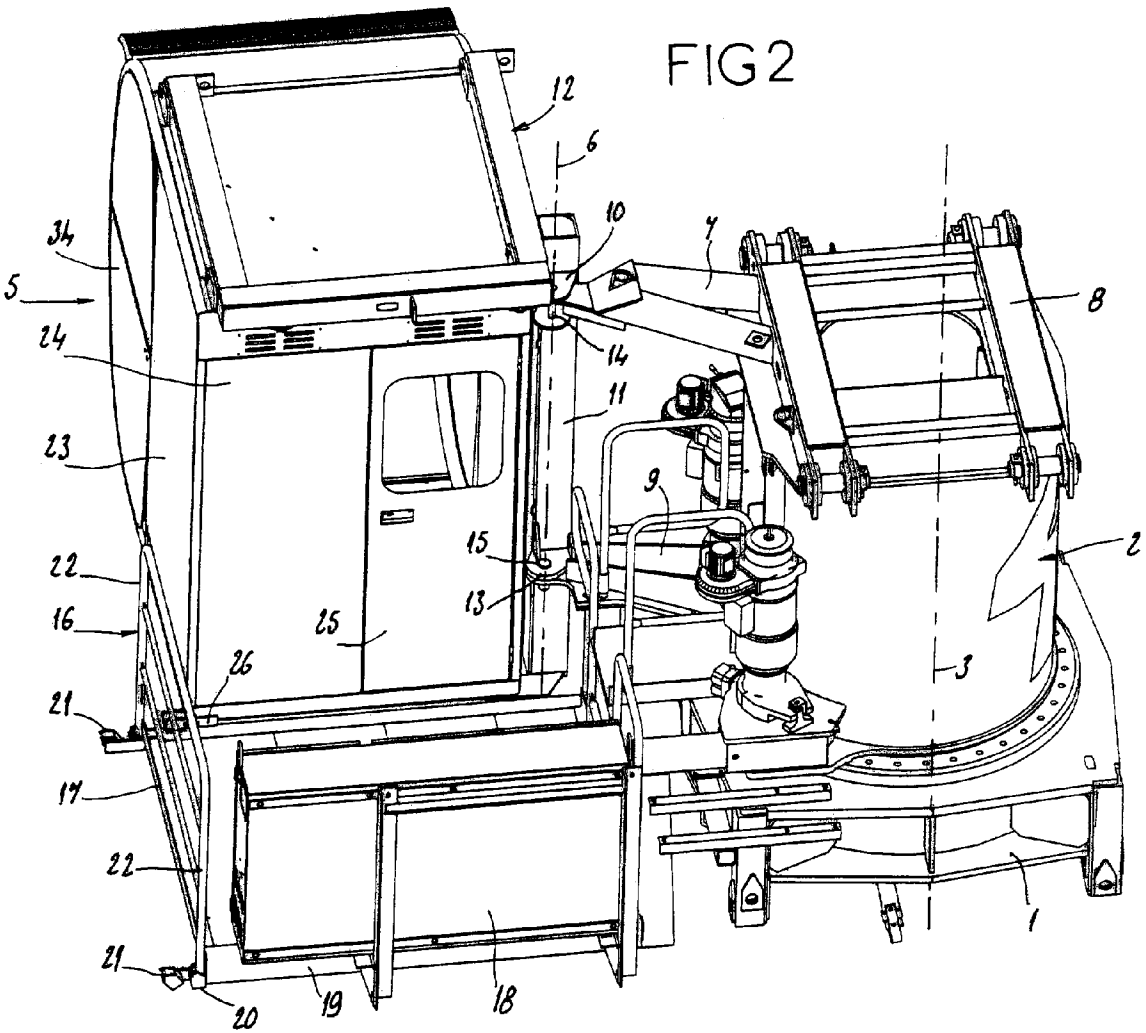
FIG. 2 is another more "bird's eye" perspective view of the cab/pivot unit, still in the operating position.
Figure 3:
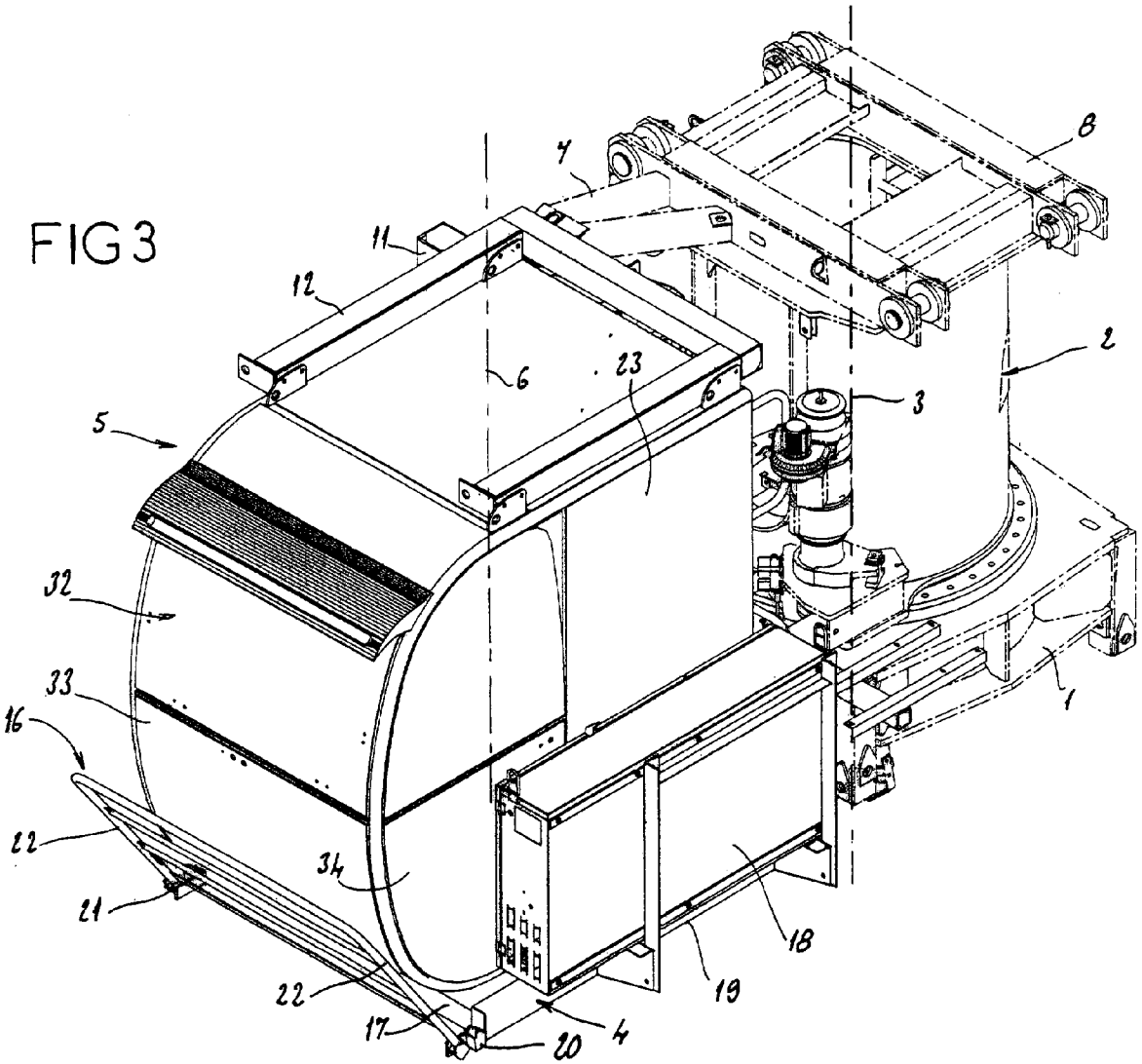
FIG. 3 is another perspective view of this cab/pivot unit, the cab being in the folded transport position.

FIGS. 1 to 3 show, as a whole, a cab/pivot unit for a tower crane, which comprises, as main components:

- a pivot 1 surmounted by an upper mast element 2 orientable about a vertical axis 3;
- a horizontal platform 4 which extends horizontally at the side of the mast element 2 and which is integral with this mast element 2;
- a crane driver's cab 5 mounted pivotably about another vertical axis 6 located at the side of the mast element 2 and linked in terms of rotation to this mast element 2 and therefore also to the platform 4.

The pivot 1 is intended to be fastened to the top of the mast (not illustrated) of a tower crane. The upper mast element 2 orientable on the pivot 1 is intended to support the jib (not illustrated) of the crane.

The pivotable mounting of the cab 5 about the vertical axis 6 in relation to the upper mast element 2 is carried out by means of a double hinge. This hinge comprises, toward the mast element 2, a triangulated upper support 7, welded to an upper frame 8 of the mast element 2, and a triangulated lower support 9, welded to the base of the mast element 2. The hinge also comprises, toward the cab 5, an upper support 10, welded to a vertical beam 11 of the carrying structure 12 of the cab 5, toward the top of this carrying structure 12, and a lower support 13, welded to the vertical beam 11 of the carrying structure 12 of the cab 5, toward the base of this carrying structure 12. Finally, the hinge comprises two vertical axles, to be precise an upper axle 14 connecting the two upper supports 8 and 10 in an articulated manner and a lower axle 15 connecting the two lower supports 9 and 13 in an articulated manner.

The platform 4, which allows access to the driver's cab 5, comprises a lateral railing 16 which extends along one of its outer edges 17. This platform 4 also supports an electrical cabinet 18 which extends along the outer edge 19, perpendicular to the edge 17, of said platform.

Figure 4:
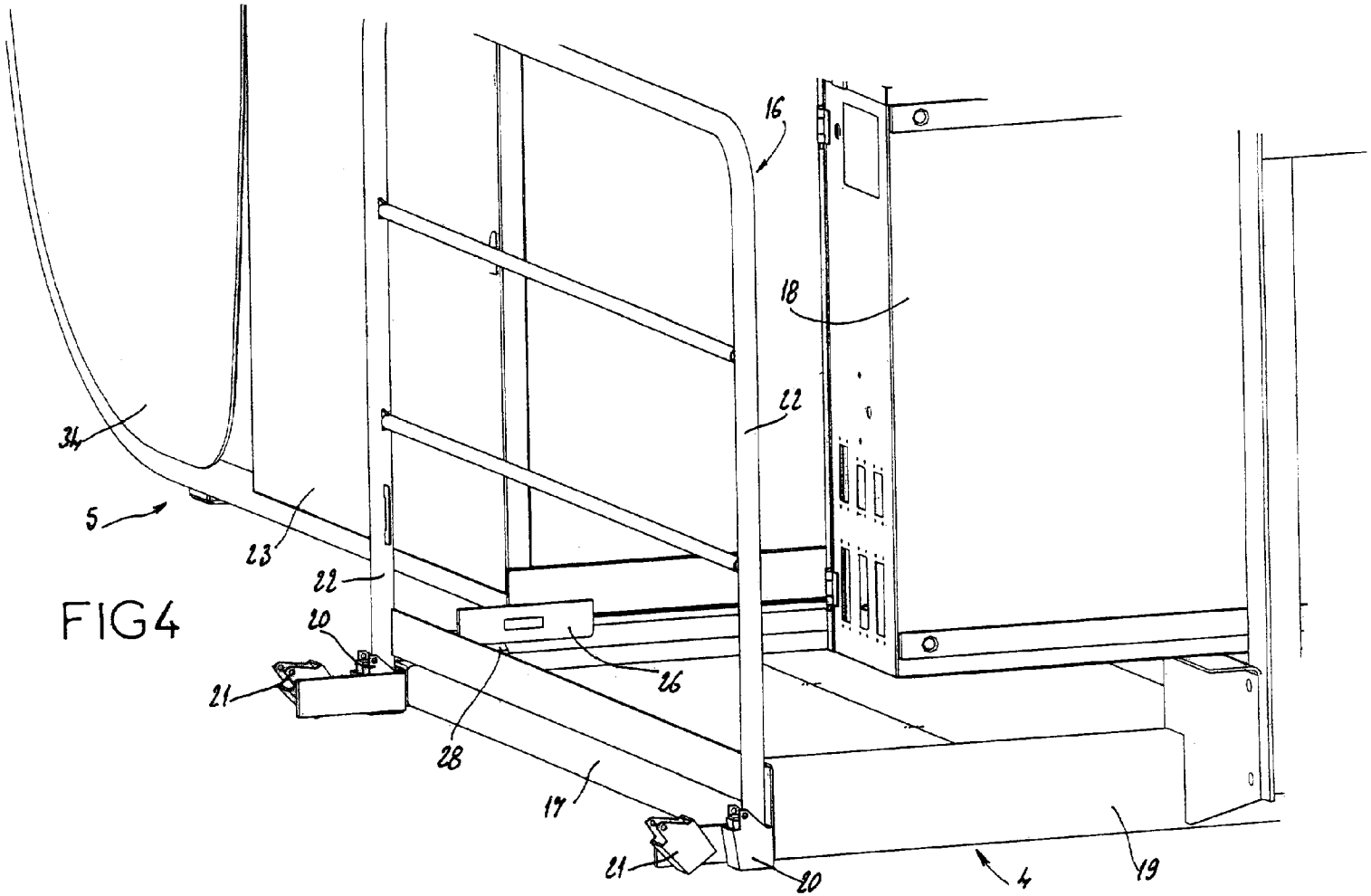
FIG. 4 is a first perspective view of a detail, showing the means for fastening the lateral railing of the access platform.

In detail, as also shown in FIG. 4, the platform 4 comprises, on its outer edge 17, two double chocks 20, 21 provided for receiving removably the two feet of the uprights 22 of the railing 16 which has two fastening positions. The chocks 20 make it possible to fasten the railing 16 in a vertical orientation. The other chocks 21 make it possible to fasten the same railing 16 in an oblique orientation, projecting outward in relation to the edge 17 of the platform 4. Dowels ensure that the fastening of the railing 16 is secured, to prevent any accidental release from the chocks 20 or 21.

By virtue of its pivotable mounting about the vertical axis 6, the driver's cab 5 can be brought into an operating position (FIGS. 1 and 2) or into a folded transport position (FIG. 3), the passage from one position to the other taking place manually as a result of a rotation through 90° about the vertical axis 6 in one direction or in the other—see the arrows F1 and F2 of FIG. 1.

In the operating position (FIGS. 1, 2 and 5), the driver's cab 5 is located in the extension of the access platform 4, in front of the upper mast element 2. The lateral railing 16, then fastened vertically to the outer edge 17 of the platform 4, is located in the extension of a lateral face 23 of the cab 5. The platform 4 thus gives access to the cab 5, the rear face 24 of this cab 5 being provided with a door 25 which opens toward the platform 4.

Figure 5:
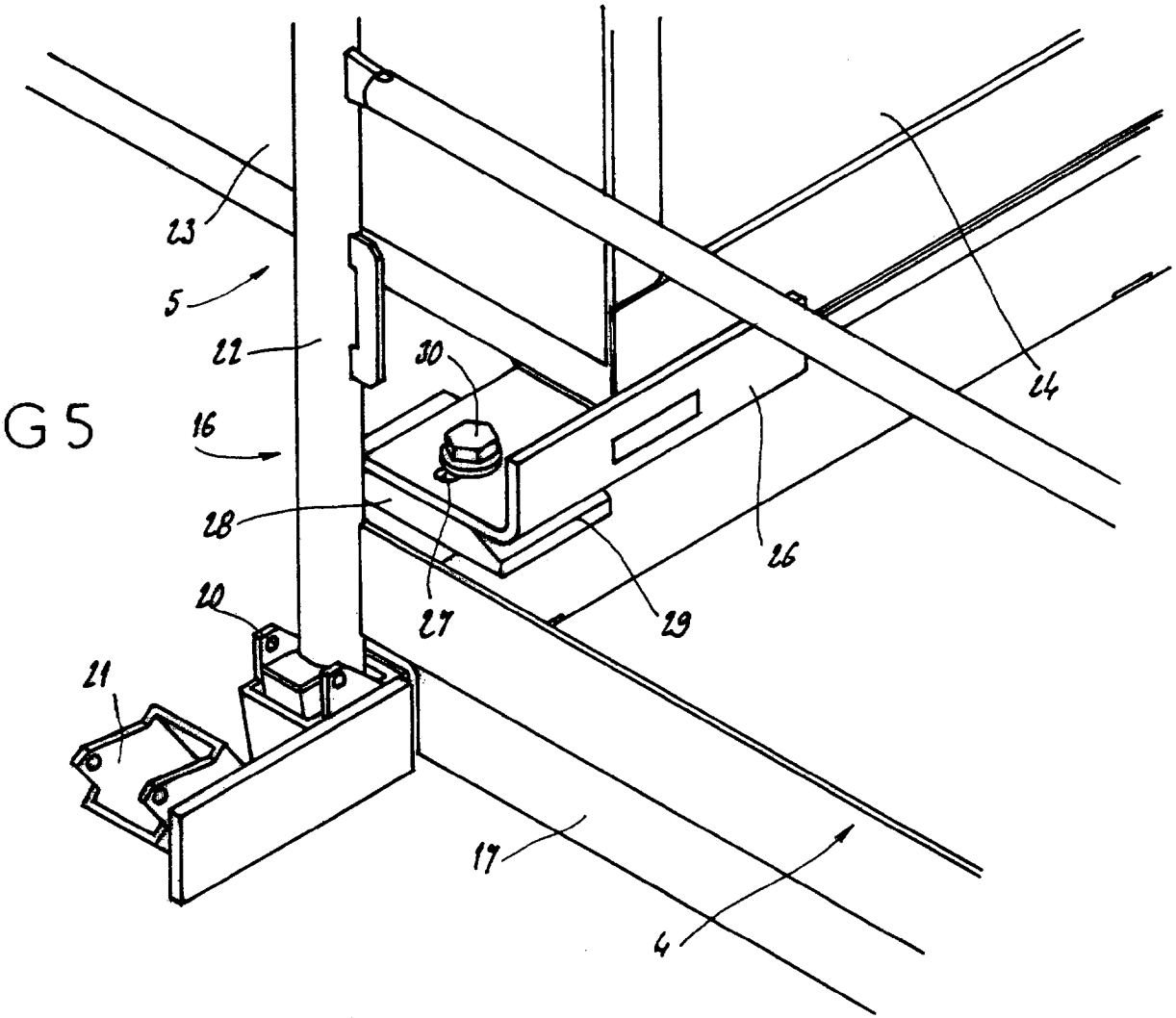
FIG. 5 is another perspective view of a detail, showing the means for locking the cab in the operating position.

As shown particularly in FIG. 5, the driver's cab 5 is locked in its operating position by means of a device which comprises:

- on the base of the cab 5, at the rear of the latter (toward the lateral face 23): a bent plate 26 fastened by bolting of the cab 5, with a projecting part pierced with a slot 27;
- on the platform 4: a plate 28 having a chamfer 29 and fastened by welding;
- between the two plates 26 and 28: a connection by bolt 30, put in place when the cab 5 is brought into the operating position.

In the transport position (FIG. 3), the driver's cab 5 has an orientation at 90° with respect to its operating position, and it is thus folded:

- on the one hand, against the upper mast element 2, the rear face 24 of the cab 5 being turned toward this mast element 2;
- on the other hand, against the electrical cabinet 18, the lateral face 23 of the cab 5 taking its place in front of this cabinet 18.

The cab 5 is thus brought above the platform 4 (and no longer in front of this platform 4), thus considerably reducing the bulk of the cab/pivot unit.

Figure 6:
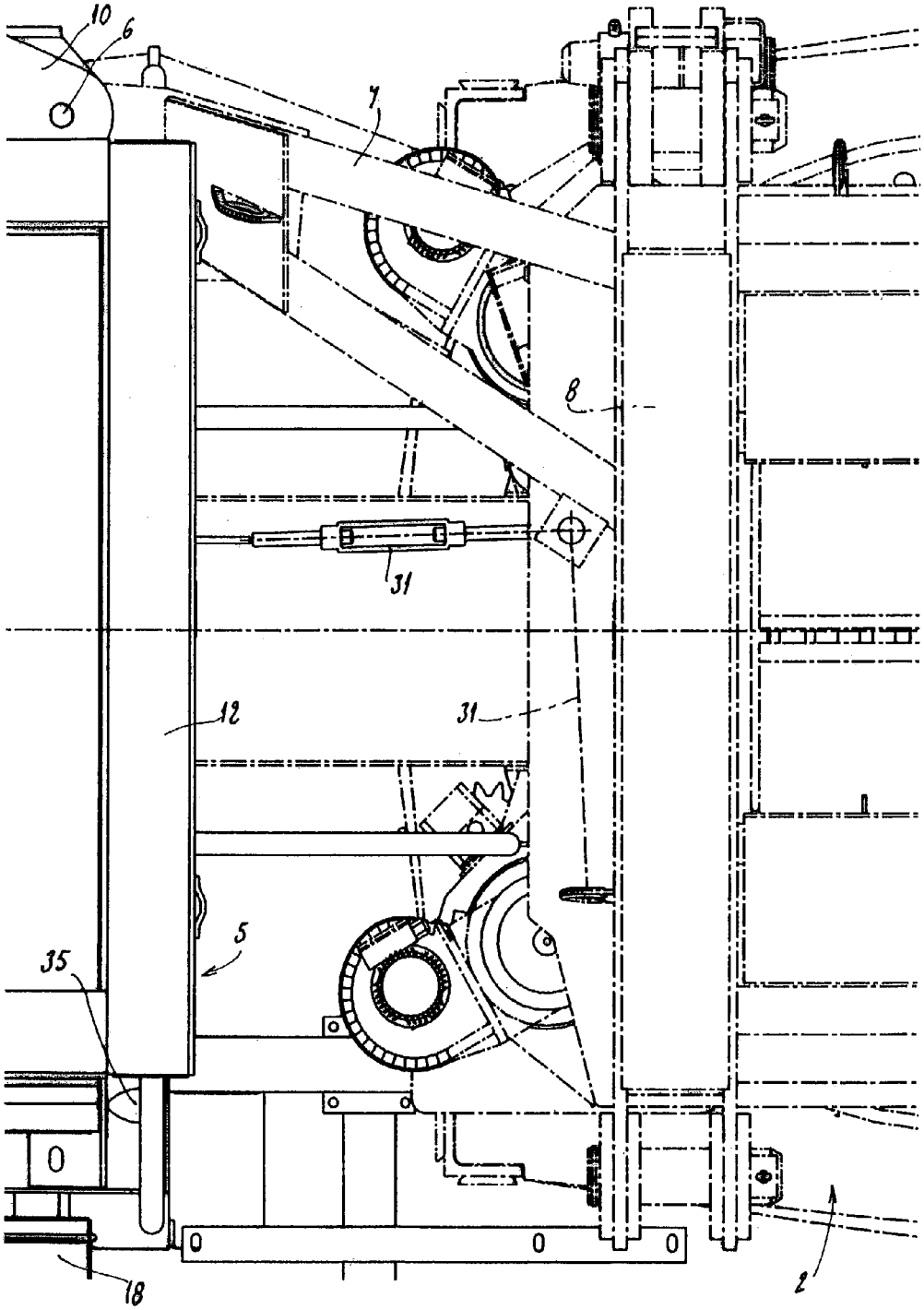
FIG. 6 is another view of a detail, in plan from above, showing the means for locking the cab in the folded transport position.

Referring also to FIG. 6, the driver's cab 5 is locked in its folded transport position by means of a turnbuckle tensioner 31 mounted between the top of the mast element 2, on the one hand, and the top of the carrying structure 12 of the cab 5, on the other hand. The action of the tensioner 31 presses the base of the cab 5 against a rubber stop 35 (FIG. 6) fastened to the structure of the platform 4. When the cab 5 is in the operating position, the turnbuckle tensioner 31 is placed in a storage position, indicated (by a single axis) in broken lines.

Still considering the folded transport position of the cab 5 (see FIG. 3), the lateral railing 16 is then fastened in its oblique orientation to the outer edge 17 of the platform 4, so as to take its place in front of the front face 32 of the cab 5, taking into account the rounded shape of this front face 32. The railing 16 thus ensures the protection of the front face 32 of the cab 5, in particular of its lower glazed part 33, while the electrical cabinet 18 protects the lateral face 23 of the cab 5, in particular its lateral glazed part 34.

To pass from the folded transport position (FIGS. 3 and 6) to the operating position (FIGS. 1, 2 and 5), it is appropriate to release the turnbuckle tensioner 31 and to place it in the storage position, after which the cab 5 is oriented manually through 90° (arrow F1 of FIG. 1). When it has thus reached the operating position, the cab 5 is locked by the plates 26 and 28 being bolted to one another. Finally, the lateral railing 16 is fastened in its vertical position.

The entire cab/pivot unit is prewired electrically, so that there is no electrical connection operation to be performed at the time when it is put into operation, thus contributing to the simplicity and rapididity of implementation.

Of course, to pass from the operating position to the transport position, the operations described above are carried out in reverse order: separation of the bolted plates 26 and 28, then manual orientation of the cab through 90° in the opposite direction (arrow F2 of FIG. 1), finally putting in place and tightening of the tensioner 31, and fastening of the railing 16 in its oblique position.

The cab/pivot unit described above can be used for tower cranes with a "suspended" driver's cab, of any configuration.

There will be no departure from the scope of the invention, as defined in the accompanying claims:

- by modifying the structural details, such as those of the articulated connection between the cab and the mast element;
- by using other means for locking the cab in its operating position and in its folded transport position;
- by adapting the invention to cranes with driver's cabs of any configuration and of any dimension.

What is claimed is:

1. A foldable cab/pivot unit for a tower crane, comprising, in combination:

- an upper mast element associated with a pivot, the mast element having a vertically oriented operating position defining an upright axis of the pivot;
- a cab access platform extending horizontally at one side of the mast element when the mast element is at the vertical oriented operating position; and
- a crane driver's cab mounted pivotably about a vertical axis located at the side of the mast element when the mast element is at the vertically oriented operating position and linked to the mast element, the cab being orientable about the vertical axis and through approximately 90° between:
- an operating position, in which the cab is located in an extension of the access platform, in front of the mast element, and
- a transport position, in which the cab is folded above the access platform, substantially in line horizontally with the mast element.

2. The cab/pivot unit as claimed in claim 1, wherein the driver's cab is articulated on the mast element by means of a vertical double hinge comprising, toward the mast element, an upper support and a lower support which are fastened respectively to a top and to a base of the mast element, and, toward the cab, an upper support and a lower support which are fastened respectively to a top and to a base of a carrying structure of the cab, the upper supports and the lower supports being connected by means of, respectively, upper and lower vertical axles.

3. The cab/pivot unit as claimed in claim 1, comprising means for locking the driver's cab in its operating position and in its folded transport position.

4. The cab/pivot unit as claimed in claim 3, wherein the means for locking the driver's cab in the operating position include plates integral respectively with the base of the cab and with the access platform to the cab and intended to be bolted to one another.

5. The cab/pivot unit as claimed in claim 3, wherein the means for locking the driver's cab in the folded transport position include a turnbuckle tensioner mounted between a top of the mast element and the top of a carrying structure of the cab, in combination with an elastic stop fastened to the cab access platform.

6. The cab/pivot unit as claimed in claim 1, wherein the cab access platform comprises a removable and/or inclinable lateral railing which:

- in the operating position of the driver's cab, is fastened in a vertical position and is located in an extension of a lateral face of the cab, and
- in the folded transport position of the driver's cab, is fastened in one of a vertical position and an oblique position projecting toward an outside of the cab access platform, so as to protect a front face of the cab.

7. The cab/pivot unit as claimed in claim 6, wherein means for fastening the lateral railing to the access platform to the cab comprise, on an outer edge of the platform, double chocks receiving feet of uprights of the railing.

8. The cab/pivot as claimed in claim 7, wherein the means for fastening fixes the one of the vertical and oblique orientation of the uprights, and thus fixes the railing.

9. The cab/pivot unit as claimed in claim 6, wherein the cab access platform supports, perpendicularly to its lateral railing, an electrical cabinet which is thus accessible from the platform, the driver's cab, in the folded transport position, also taking its place against the electrical cabinet in such a way that a lateral glazed part of the cab is also protected.

10. The cab/pivot unit as claimed in claim 6, wherein the front face of the cab includes a lower glazed part and the lateral railing protects the lower glazed part when the driver's cab is in the folded transport position.

11. The cab/pivot as claimed in claim 1, wherein the cab is orientable pivotally about the vertical axis by manual action.

12. A tower crane including a foldable cab/pivot unit, the foldable cab/pivot unit comprising, in combination:

an upper mast element associated with a pivot, the mast element having a vertically oriented operating position defining an upright axis of the pivot;

a cab access platform extending horizontally at one side of the mast element when the mast element is at the vertical oriented operating position; and a crane driver's cab mounted pivotably about a vertical axis located at the side of the mast element when the mast element is at the vertically oriented operating position and linked to the mast element, the cab being orientable about the vertical axis and through approximately 90° between:

an operating position, in which the cab is located in an extension of the access platform, in front of the mast element, and a transport position, in which the cab is folded above the access platform, substantially in line horizontally with the mast element.

* * * * *